US008174452B2

(12) United States Patent
Ayala Vazquez et al.

(10) Patent No.: US 8,174,452 B2
(45) Date of Patent: May 8, 2012

(54) CAVITY ANTENNA FOR WIRELESS ELECTRONIC DEVICES

(75) Inventors: Enrique Ayala Vazquez, Watsonville, CA (US); Hao Xu, Cupertino, CA (US); Gregory A. Springer, Sunnyvale, CA (US); Bing Chiang, Cupertino, CA (US); Eduardo Lopez Camacho, Watsonville, CA (US); Douglas B. Kough, San Jose, CA (US)

(73) Assignee: Apple Inc., Cupertino, CA (US)

( * ) Notice: Subject to any disclaimer, the term of this patent is extended or adjusted under 35 U.S.C. 154(b) by 391 days.

(21) Appl. No.: 12/238,384

(22) Filed: Sep. 25, 2008

(65) Prior Publication Data

US 2010/0073241 A1 Mar. 25, 2010

(51) Int. Cl.
*H01Q 1/24* (2006.01)

(52) U.S. Cl. ..... 343/702; 343/700 MS

(58) Field of Classification Search ..... 343/702, 343/700 MS, 895
See application file for complete search history.

(56) References Cited

U.S. PATENT DOCUMENTS

| | | | |
|---|---|---|---|
| 4,733,245 | A | 3/1988 | Mussler |
| 6,081,729 | A | 6/2000 | Bauerschmidt et al. |
| 6,225,959 | B1 | 5/2001 | Gordon |
| 6,339,400 | B1 | 1/2002 | Flint et al. |
| 6,369,771 | B1 | 4/2002 | Chiang et al. |
| 6,380,930 | B1 | 4/2002 | Van Ruymbeke |
| 6,653,983 | B2 | 11/2003 | Masuda et al. |
| 6,670,923 | B1 | 12/2003 | Kadambi et al. |
| 6,686,886 | B2 | 2/2004 | Flint et al. |
| 6,741,214 | B1 | 5/2004 | Kadambi et al. |
| 6,747,601 | B2 | 6/2004 | Boyle |
| 6,774,852 | B2 | 8/2004 | Chiang et al. |
| 6,791,497 | B2 * | 9/2004 | Winebrand et al. ..... 343/702 |
| 6,853,336 | B2 | 2/2005 | Asano et al. |
| 6,856,294 | B2 | 2/2005 | Kadambi et al. |
| 6,879,293 | B2 | 4/2005 | Sato |
| 6,888,510 | B2 | 5/2005 | Jo et al. |
| 6,894,650 | B2 | 5/2005 | Darden et al. |
| 6,922,175 | B2 | 7/2005 | Walton |
| 6,950,069 | B2 | 9/2005 | Gaucher et al. |
| 6,980,154 | B2 | 12/2005 | Vance et al. |
| 7,027,838 | B2 | 4/2006 | Zhou et al. |

(Continued)

OTHER PUBLICATIONS

Ayala Vazquez et al., U.S. Appl. No. 12/486,496, filed Jun. 17, 2009.

(Continued)

*Primary Examiner* — Hoanganh Le
(74) *Attorney, Agent, or Firm* — Treyz Law Group; David C. Kellogg; Louis R. Levenson

(57) ABSTRACT

Wireless portable electronic devices such as laptop computers are provided with cavity-backed monopole antennas. A wireless device may have a housing. Conductive portions of the housing such as a conductive outer metal layer and internal frame structures may form a cavity having conductive walls. An antenna resonating element structure may be formed from monopole antenna resonating element arms of dissimilar lengths. One of the arms may be straight and another of the arms may be implemented using a meandering path. The antenna resonating element may be mounted over the cavity to form a cavity-backed monopole antenna. A display within the device may be covered by a cover glass. An opaque bezel region around the periphery of the cover glass may cover the antenna and block it from view. The antenna resonating element arms may run parallel to the longitudinal axis of the cavity.

19 Claims, 10 Drawing Sheets

U.S. PATENT DOCUMENTS

| | | | | |
|---|---|---|---|---|
| 7,116,267 | B2 | 10/2006 | Schuster et al. | |
| 7,119,747 | B2 | 10/2006 | Lin et al. | |
| 7,123,208 | B2 | 10/2006 | Baliarda et al. | |
| 7,129,902 | B2 | 10/2006 | Bancroft | |
| 7,239,290 | B2 | 7/2007 | Poilasne et al. | |
| 7,605,766 | B2 * | 10/2009 | Dahlstrom et al. | 343/702 |
| 7,675,470 | B2 * | 3/2010 | Sanz et al. | 343/702 |
| 2002/0135522 | A1 * | 9/2002 | Yamamoto et al. | 343/702 |
| 2003/0107518 | A1 | 6/2003 | Li et al. | |
| 2003/0189521 | A1 * | 10/2003 | Yamamoto et al. | 343/702 |
| 2004/0145521 | A1 | 7/2004 | Hebron et al. | |
| 2004/0183731 | A1 * | 9/2004 | Darden et al. | 343/702 |
| 2005/0024278 | A1 * | 2/2005 | Amemiya et al. | 343/702 |
| 2005/0146475 | A1 | 7/2005 | Bettner et al. | |
| 2006/0055606 | A1 | 3/2006 | Boyle | |
| 2006/0152417 | A1 * | 7/2006 | Ying et al. | 343/702 |
| 2006/0244663 | A1 | 11/2006 | Fleck et al. | |
| 2009/0153412 | A1 * | 6/2009 | Chiang et al. | 343/702 |

OTHER PUBLICATIONS

Bevelacqua et al., U.S. Appl. No. 12/750,661, filed Mar. 30, 2010.
Shiu et al., U.S. Appl. No. 12/750,660, filed Mar. 30, 2010.
Chiang et al., U.S. Appl. No. 12/500,570, filed Jul. 9, 2009.
Chiang, U.S. Appl. No. 12/356,496, filed Jan. 20, 2009.
Chiang et al., U.S. Appl. No. 12/401,599, filed Mar. 10, 2009.
Guterman et al., U.S. Appl. No. 12/553,943, filed Sep. 3, 2009.
Vazquez et al., U.S. Appl. No. 12/553,944, filed Sep. 3, 2009.
U.S. Appl. No. 12/104,359, filed Apr. 16, 2008, Bing Chiang et al.
Hill et al. U.S. Appl. No. 11/650,187, filed Jan. 4, 2007.
Hill et al. U.S. Appl. No. 11/821,192, filed Jun. 21, 2007.
Hill et al. U.S. Appl. No. 11/897,033, filed Aug. 28, 2007.
Zhang et al. U.S. Appl. No. 11/895,053, filed Aug. 22, 2007.
Chiang et al. U.S. Appl. No. 11/702,039, filed Feb. 2, 2007.
R. Bancroft "A Commercial Perspective on the Development and Integration of an 802.11a/b/g HiperLan/WLAN Antenna into Laptop Computers", IEEE Antennas and Propagation Magazine, vol. 48, No. 4, Aug. 2006, pp. 12-18.
B. Chiang et al. "Invasion of Inductor and Capacitor Chips in the Design of Antennas and Platform Integration", IEEE International Conference on Portable Information Devices, May 2007, pp. 1-4.
A. Lai et al. "Infinite Wavelength Resonant Antennas With Monopolar Radiation Pattern Based on Periodic Structures", IEEE Transactions on Antennas and Propagation, vol. 55, No. 3, Mar. 2007, pp. 868-876.

* cited by examiner

CAVITY ANTENNA FOR WIRELESS ELECTRONIC DEVICES

BACKGROUND

This invention relates to wireless electronic devices, and more particularly, to antennas for wireless electronic devices such as portable electronic devices.

Antennas are used in conjunction with a variety of electronic devices. For example, computers use antennas to support wireless local area network communications. Antennas are also used for long-range wireless communications in cellular telephone networks.

It can be difficult to design antennas for modern electronic devices, particularly in electronic devices in which compact size and pleasing aesthetics are important. If an antenna is too small or is not designed properly, antenna performance may suffer. At the same time, an overly-bulky antenna or an antenna with an awkward shape may detract from the appearance of an electronic device or may make the device larger than desired.

It would therefore be desirable to be able to provide improved antennas for electronic devices such as portable electronic devices.

SUMMARY

Wireless portable electronic devices such as laptop computers are provided with cavity-backed monopole antennas. A wireless device may have a housing. The housing may have an upper housing portion and a lower housing portion. The upper housing portion may be a structure such as the cover of a laptop computer. The lower housing portion may be the base portion of a laptop computer.

The housing of the portable electronic device may have conductive structures. These conductive structures may include a metal layer that forms an outer surface for the upper housing and a frame within the upper housing to which a display is mounted. A conductive cavity may be formed from the conductive structures. The lower surface of the cavity may be formed from the metal layer that forms the outer surface for the upper housing. Sidewalls for the cavity may be formed from portions of the frame.

An antenna resonating elements structure may be mounted over the cavity to form a cavity-backed monopole antenna. The antenna resonating element structure may have two arms that run parallel to the longitudinal axis of the cavity. The arms may have unequal lengths to broaden the bandwidth of the antenna.

The antenna may operate in a frequency range of about 2.4 GHz to 2.5 GHz or other suitable frequency range. The cavity may have dimensions that are substantially less than a half of a wavelength at the antenna's desired operating frequency.

A cover glass in the upper housing may be used to protect the display. A bezel region may be formed around the periphery of the cover glass. The interior of the cover glass may be transparent to allow the display to be viewed. The bezel region may be provided with an underlayer of ink or other substance that renders the bezel region opaque.

When the cover glass is mounted to the upper housing portion, the bezel may overlap and cover the antenna resonating element and cavity and thereby block the antenna from view.

Further features of the invention, its nature and various advantages will be more apparent from the accompanying drawings and the following detailed description of the preferred embodiments.

DETAILED DESCRIPTION

The present invention relates to antennas for wireless electronic devices. The wireless electronic devices may, in general, be any suitable electronic devices. As an example, the wireless electronic devices may be desktop computers or other computer equipment. The wireless electronic devices may also be portable electronic devices such as laptop computers or small portable computers of the type that are sometimes referred to as ultraportables. Portable wireless electronic devices may also be somewhat smaller devices. Examples of smaller portable electronic devices include wrist-watch devices, pendant devices, headphone and earpiece devices, other wearable and miniature devices, and handheld electronic devices. The portable electronic devices may be cellular telephones, media players with wireless communications capabilities, handheld computers (also sometimes called personal digital assistants), remote controls, global positioning system (GPS) devices, and handheld gaming devices. Devices such as these may be multifunctional. For example, a cellular telephone may be provided with media player functionality or a tablet personal computer may be provided with the functions of a remote control or GPS device.

Arrangements in which cavity antennas are incorporated into portable computers such as laptops are sometimes described herein as an example. This is, however, merely illustrative. Cavity antennas in accordance with embodiments of the present invention may be used in any wireless electronic devices.

Figure 1:
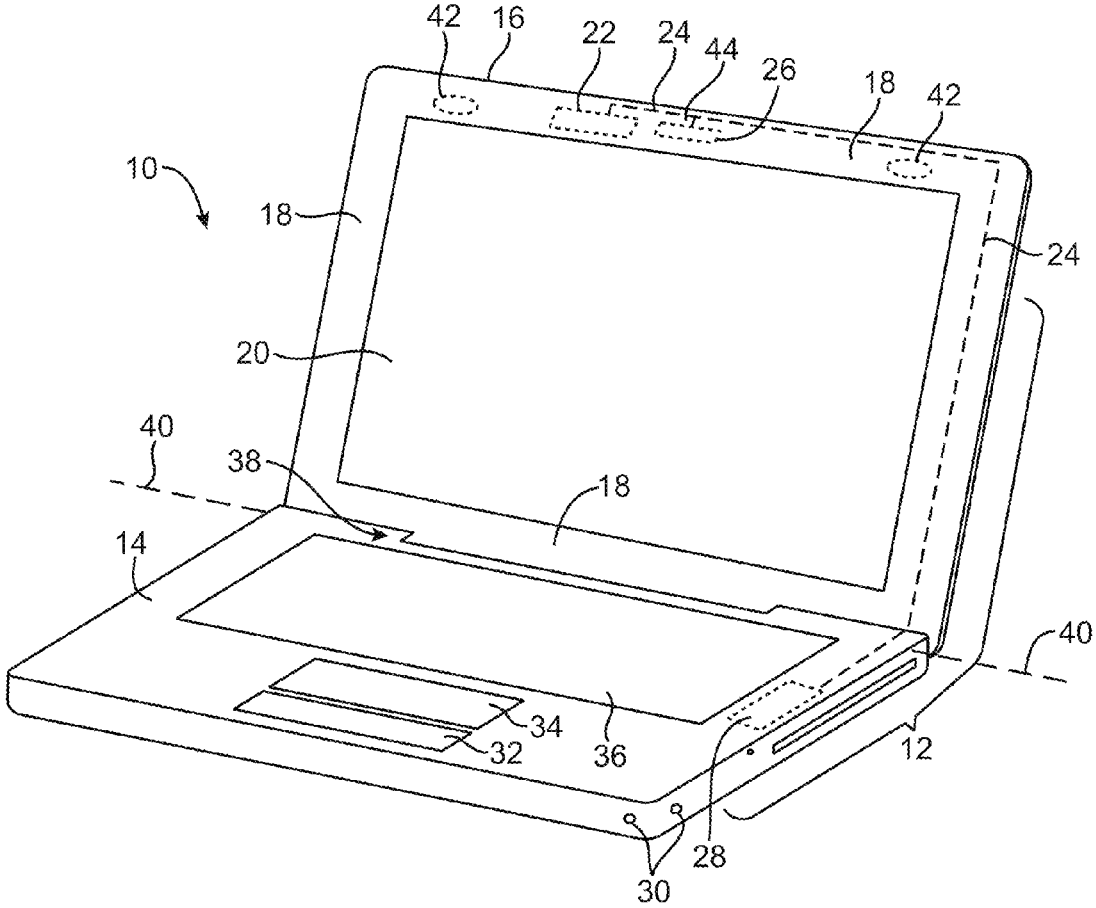
FIG. 1 is a perspective view of an illustrative wireless electronic device such as a laptop computer that may be provided with antenna structures in accordance with an embodiment of the present invention.

An illustrative electronic device such as a portable electronic device in accordance with an embodiment of the present invention is shown in FIG. 1. Device 10 may be any suitable electronic device. As an example, device 10 may be a laptop computer.

As shown in FIG. 1, device 10 may have a housing 12. Housing 12, which is sometimes referred to as a case, may have an upper portion such as portion 16 and lower portion such as portion 14. Upper housing portion 16 may sometimes be referred to as a cover or lid. Lower housing portion 14 may sometimes be referred to as a base. A hinge mechanism such as hinge 38 may be used to attach cover 16 to base 14. Hinge 38 may allow cover 16 to rotate relative to base 14 about rotational axis 40. If desired, other attachment mechanisms may be used such as a rotating and pivoting hinge for a tablet computer. Device 10 may also be implemented using a one-piece housing. In devices with two-piece housings, the hinge portion of the device may contain a spring-like clutch mechanism and may therefore sometimes be referred to as a clutch barrel.

Device 10 may have a display such as display 20. Display 20 may be, for example, a liquid crystal display (LCD), an organic light emitting diode (OLED) display, or a plasma display (as examples). If desired, touch screen functionality may be incorporated into display 20. The touch screen may be responsive to user input.

Device 10 may also have other input-output devices such as keypad 36, touch pad 34, and buttons such as button 32. Input-output jacks and ports 30 may be used to provide an interface for accessories such as a microphone and headphones. A microphone and speakers may also be incorporated into housing 12.

The edges of display 20 may be surrounded by a bezel 18. Bezel 18 may be formed from a separate bezel structure such as a plastic ring or may be formed as an integral portion of a cover glass layer that protects display 20. For example, bezel 18 may be implemented by forming an opaque black glass portion for display 20 or an associated cover glass piece. This type of arrangement may be used, for example, to provide upper housing 16 with an attractive uncluttered appearance. Illustrative configurations in which device 10 uses a glass bezel formed from the outer periphery of a sheet of display cover glass are sometimes described herein as an example.

When cover 16 is in a closed position, display 20 will generally lie flush with the upper surface of lower housing 14. In this position, magnets on cover 16 may help hold cover 16 in place. Magnets may be located, for example, behind bezel portion 18 in regions 42.

A camera such as camera 26 may also be mounted behind bezel region 18. A window such as window 44 may be used to provide an opening for a lens in camera 26.

Housing 12 may be formed from any suitable materials such as plastics, metals, glass, ceramic, carbon fiber, composites, combinations of plastic and metal, etc. To provide good durability and aesthetics, it is often desirable to use metal to form at least the exterior surface layer of housing 12. Interior portions such as frames and other support members may be formed from plastic in areas where light weight and radio-frequency transparency are desired and may be formed from metal in areas where good structural strength is desirable.

Particularly in devices in which cover 16 and lower housing portion 14 are formed from metal, it can be challenging to properly locate antenna structures. Antenna structures that are blocked by conductive materials such as metal will not generally function properly.

In accordance with embodiments of the present invention, an antenna may be formed from a conductive cavity that is located behind bezel region 18. An antenna with this type of configuration is shown in FIG. 1 as antenna 22.

In general, cavity antennas and other types of antennas may be located in any suitable portion of device 10. For example, antennas may be located in the exterior surface of upper housing 16, in the exterior surface of lower housing 14, along the edges of housing 12, on the interior surface of housing portion 14, behind bezel 18, etc. An advantage of forming antenna 22 behind bezel 18 in the location shown in FIG. 1 is that this type of location allows incoming radio-frequency signals to reach antenna 22 without being impeded by conductive display or housing portions and allows radio-frequency signals to be freely transmitted from antenna 22. If desired, other locations may be used for antenna 22. Antenna 22 is located on the upper left portion of bezel 18 on cover 16 in the example of FIG. 1, but this is merely illustrative.

Device 10 may be provided with any suitable number of antennas. There may be, for example, one antenna (antenna 22), two antennas, three antennas, or more than three antennas, in device 10. Each antenna may handle communications over a single communications band or multiple communications bands.

Device 10 may use antennas such as antenna 22 to handle communications over any communications bands of interest. For example, antennas and wireless communications circuitry in device 10 may be used to handle cellular telephone communications in one or more frequency bands and data communications in one or more communications bands. Typical data communications bands that may be handled by the wireless communications circuitry in device 10 include the 2.4 GHz band that is sometimes used for Wi-Fi® (IEEE 802.11) and Bluetooth® communications, the 5 GHz band that is sometimes used for Wi-Fi communications, the 1575 MHz Global Positioning System band, and 3G bands (e.g., the UMTS band at 1920-2170). These bands may be covered using single-band and multiband antennas. For example, cellular telephone communications can be handled using a multiband cellular telephone antenna and local area network data communications can be handled using a multiband wireless local area network antenna. As another example, device 10 may have a single multiband antenna for handling communications in two or more data bands (e.g., at 2.4 GHz and at 5 GHz).

With one illustrative arrangement, which is sometimes described herein as an example, antenna 22 is configured to handle Bluetooth® signals at 2.4 GHz (as an example). One or more additional antennas may be provided in device 10 if desired.

Device 10 may have integrated circuits such as a microprocessor. Integrated circuits may also be included in device 10 for memory, input-output functions, etc. Circuitry in device 10 such as integrated circuits and other circuit components may be located in lower housing portion 14. For example, a main logic board (sometimes referred to as a motherboard) may be used to mount some or all of this circuitry. The main logic board circuitry may be implemented using a single printed circuit board or multiple printed circuit boards. Printed circuit boards in device 10 may be formed from rigid printed circuit board materials or flexible printed circuit board materials. An example of a rigid printed circuit board material is fiberglass filled epoxy. An example of a flexible printed circuit board material is polyimide. Flexible printed circuit board structures may be used for mounting integrated circuits and other circuit components and may be used to form communications pathways in device 10. Flexible printed circuit board structures such as these are sometimes referred to as "flex circuits."

If desired, circuitry in device 10 may be located in cover 16. For example, circuitry for supporting camera functions for camera 26 may be mounted on a camera module in the vicinity of camera 26. Wireless communications circuitry for supporting operations with antenna 22 may be mounted on a radio-frequency module associated with antenna 22. Modules such as these may be located behind bezel 18 (as an example).

As shown in FIG. 1, a communications path such as path 24 may be used to interconnect antenna 22 and camera 26 to circuitry 28 in lower housing portion 14. Path 24 may be implemented, for example, using a flex circuit that is connected to a radio-frequency antenna module associated with antenna 22 and to a camera module associated with camera 26. Circuitry 28 may include wireless communications circuitry and other processing circuitry. This circuitry may be associated with a main logic board (motherboard) in lower housing 14 (as an example). Analog radio-frequency antenna signals and/or digital data associated with antenna 22 may be conveyed over path 24. An advantage to locating radio-frequency circuitry in the immediate vicinity of antenna 22 is that this allows data to be conveyed between the motherboard in housing portion 14 and antenna 22 digitally without incurring radio-frequency transmission line losses.

Figure 2:
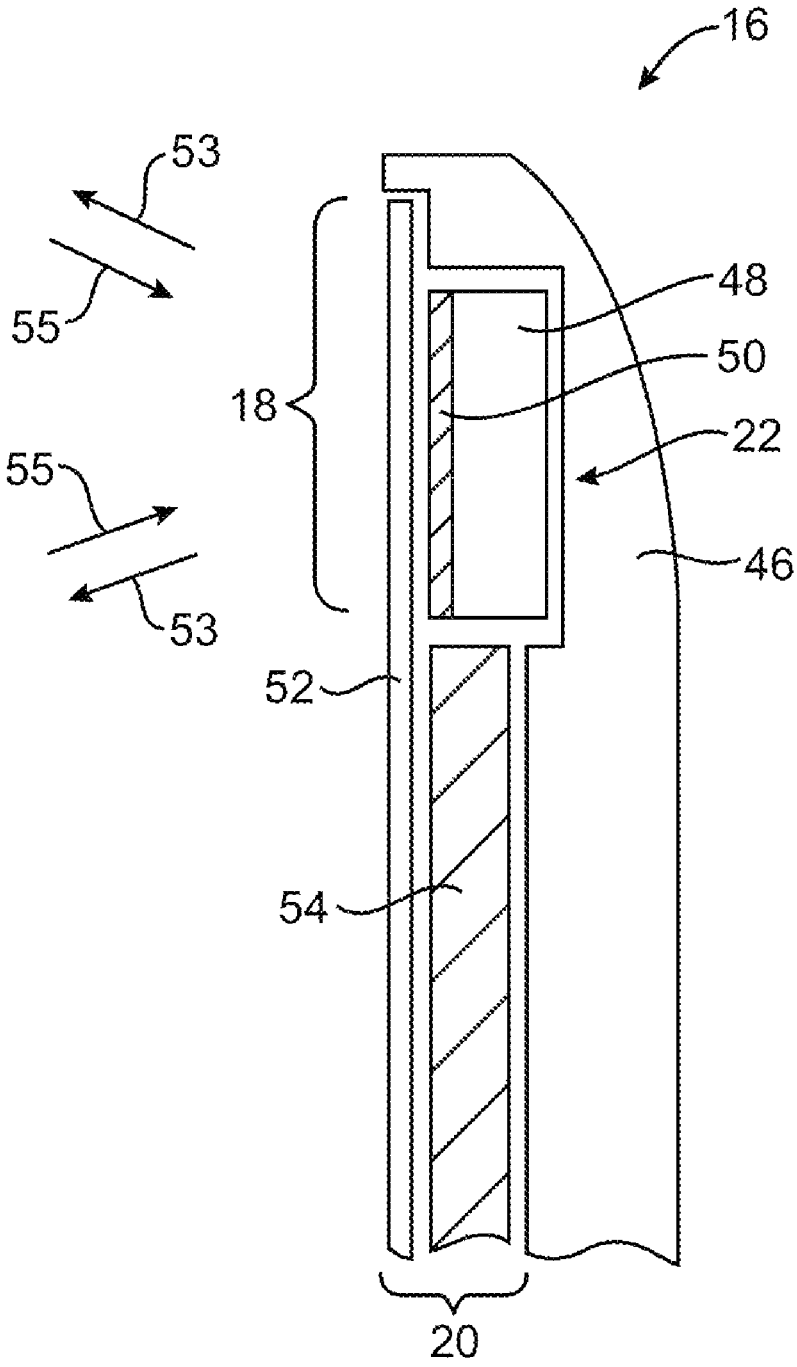
FIG. 2 is a cross-sectional end view of a portion of a wireless electronic device structure such as a laptop cover showing how an antenna with a cavity may be formed in accordance with an embodiment of the present invention.

A cross-sectional side view of an illustrative arrangement for antenna 22 when antenna 22 is formed in upper housing portion 16 is shown in FIG. 2. As shown in FIG. 2, antenna 22 may be formed from a conductive cavity 48 and antenna resonating element structure 50. These structures may be located under bezel portion 18 of display structures 20. Display structures 20 may include LCD display 54 and cover glass 52. The portion of cover glass 52 in region 18 may have an undercoat of an opaque ink such as a black ink, preventing antenna 22 from being viewed by a user of device 10. The opaque ink in region 18 may be provided in a layer that is sufficiently thin to ensure that the ink layer is transparent to radio-frequency signals. Because glass 52 is a dielectric and because the opaque ink is sufficiently thin, radio-frequency signals for antenna 22 are not blocked by glass 52 or the ink in bezel region 18.

Cavity 48 in antenna 22 may be formed from a metal frame structure such as an aluminum frame structure associated with upper housing portion 16 or any other suitable conductive structures. The frame structure may, as an example, be mounted to an interior portion of exterior housing layer 46. Housing layer 46 may be, for example, a thin metal sheet that makes up the exterior portion of upper housing portion 16.

Antenna resonating element structure 50 in antenna 22 may be formed from printed metal foil structures, wires, conductive traces on a rigid printed circuit board, conductive traces on a flex circuit, combinations of these arrangements, or other suitable arrangements. With one particularly suitable configuration, which is sometimes described herein as an example, antenna resonating element portion 50 of antenna 22 may be formed from conductive traces on a printed circuit board substrate. The conductive resonating element traces may be, for example, traces of copper, gold, other metals, etc.

During operation of antenna 22, radio-frequency signals may be transmitted out of cavity 48 as shown by arrows 53 and may be received by antenna 22 as shown by arrows 55. Wireless signals are therefore directed outwards away from housing portion 46.

Figure 3:
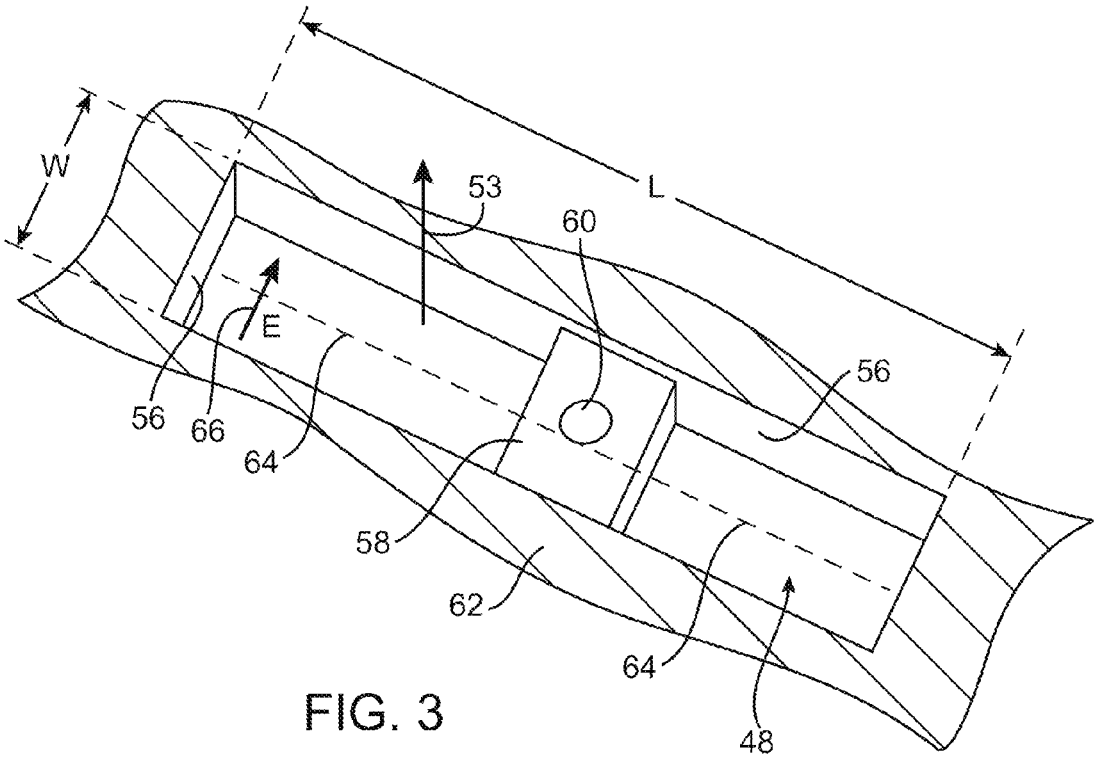
FIG. 3 is a perspective view of an illustrative antenna cavity that may make up part of a cavity antenna in a wireless electronic device in accordance with an embodiment of the present invention.

A perspective view of an illustrative cavity 48 for antenna 44 is shown in FIG. 3. In the FIG. 3 example, cavity 48 has conductive walls 56 that are formed from a metal frame structure (frame 62). Raised central portion 58 may be provided with a threaded screw hole such as hole 60. A screw may be screwed into hole 60 to hold antenna resonating element structure 50 (FIG. 2) in place. If desired, multiple screw holes or other attachment mechanisms may be used to attach antenna resonating element structure 50 to cavity 48 (e.g., rivets, adhesive, springs, etc.).

Cavity 48 may have any suitable shape. In the arrangement of FIG. 3, cavity 48 has a rectangular surface opening and forms a prism-shaped cavity within frame 62. Other shapes may be used if desired (e.g., other polyhedral shapes, cylinders, cones, shapes with both curved and flat sidewalls, irregular openings, etc. When a prism-shaped cavity of the type shown in FIG. 3 is used, cavity 48 may be characterized by a length L and a width W. Length L may be larger than width W. Longitudinal axis 64 may be aligned with the longer (longitudinal) dimension of cavity 48. When in operation handling radio-frequency signals, the electric field of the radio-frequency signals may primarily be oriented as shown by E-field arrow 66 (i.e., with the electric field component of the radio-frequency signals perpendicular to longitudinal axis 64).

It may be desirable to implement antenna 22 using a cavity with compact dimensions. Efficiency may be maximized when cavity dimensions are about one half of a wavelength at a frequency of interest. At 2.4 GHz, this dimension is about 60 mm. If desired, antenna cavity 48 may be formed with more compact dimensions (e.g., dimensions less than 10 mm, about 6 mm, or other suitable dimensions less than a half wavelength in size). Despite the use of these smaller dimensions, antenna performance has been demonstrated to be satisfactory for a variety of applications (e.g., for Bluetooth® signal transmission and reception). In general, any suitable dimensions, polarization orientation, and cavity geometry may be used for cavity 48. The configuration of FIG. 3 is merely an example.

Figure 4:
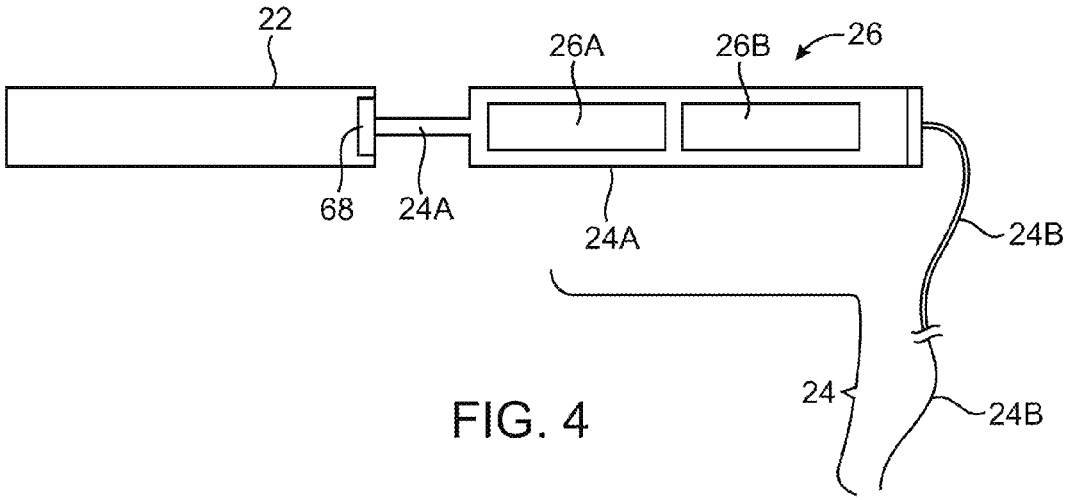
FIG. 4 is a top view of an illustrative antenna showing how a flex circuit may be used to form a connection to the antenna and additional electronic components such as camera components in accordance with an embodiment of the present invention.

As described in connection with FIG. 1, a communications path such as communications path 24 may be used to interconnect antenna 22 and camera module 26 with circuitry 28 in lower housing portion 14 of device 10. Communications path 24 may, for example, be formed at least partly from a flex circuit. A top view of antenna 22 and camera 26 is shown in FIG. 4. As shown in FIG. 4, path 24 may be formed from flex circuit portion 24A and cable portion 24B. Antenna 22 may be formed as part of an antenna module that has an associated connector 68 such as a zero insertion force (ZIF) connector to which flex circuit 24A is connected. Camera 26 may have associated components 26A and 26B such as integrated circuits, a camera unit, etc. Components 26A and 26B may be mounted on flex circuit 24A. Cable portion 24B may be electrically connected to flex circuit portion 26A to form path 24 or flex circuit portion 26A may be extended to reach circuitry 28 (FIG. 1).

Figure 5:
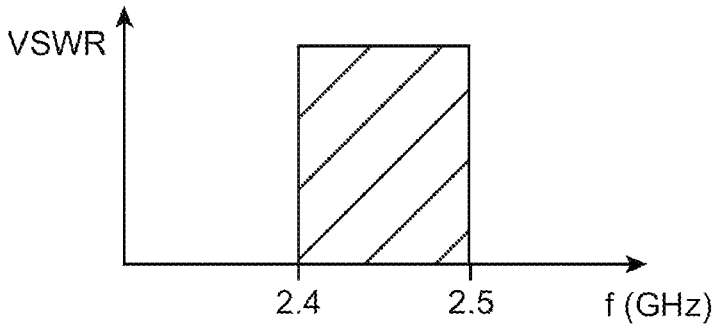
FIG. 5 is a graph showing an illustrative communications band in which a cavity antenna in a wireless electronic device may be designed to operate in accordance with an embodiment of the present invention.
Figure 6:
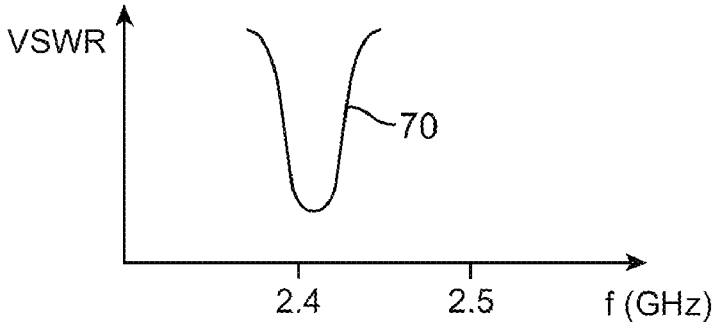
FIG. 6 is a graph showing how a cavity antenna with a single resonating element arm may have a frequency response that covers only a portion of a desired communications band in a wireless electronic device in accordance with an embodiment of the present invention.

Cavity antenna 22 may be configured to have a sufficiently wide bandwidth to cover a desired communications band. Consider, as an example, the graph of FIG. 5, which shows desired frequency coverage for a Bluetooth® antenna. In the graph of FIG. 5 and the related graphs of FIGS. 6 and 7, antenna voltage standing wave ratio (VSWR) values are plotted as a function of signal frequency. As shown in FIG. 5, when used for Bluetooth® applications, antenna 22 preferably covers frequencies in the range of about 2.4 GHz to about 2.5 GHz.

The presence of a conductive cavity in an antenna such as cavity 48 in antenna 22 tends to narrow the frequency response of the antenna. If care is not taken and the antenna resonating elements in antenna 22 are not designed to support a sufficiently large antenna bandwidth, the overall frequency response of a cavity-backed antenna may too narrow. In the FIG. 6 example, a single antenna resonating element arm is being used in antenna resonating element portion 50 of antenna 22. As a result, the bandwidth of the antenna in the FIG. 6 example is characterized by the relatively narrow bandwidth of curve 70. This frequency response may be acceptable in some circumstances, but is not sufficiently wide to cover the entire communications band of interest in FIG. 5.

Figure 7:
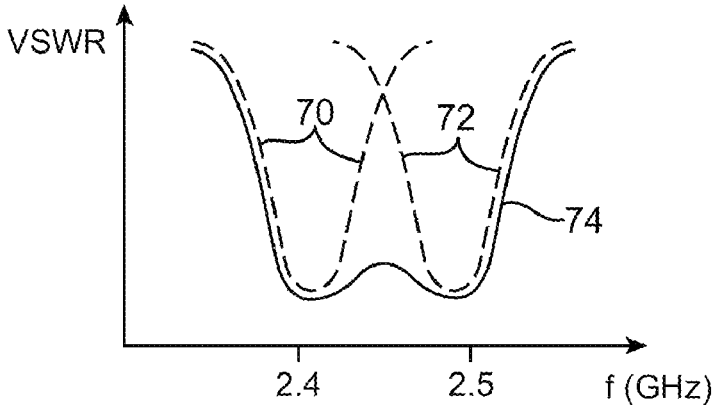
FIG. 7 is a graph showing how a cavity antenna with multiple resonating element arms may have a frequency response that fully covers a communications band of interest in a wireless electronic device in accordance with an embodiment of the present invention.

To extend the frequency coverage of antenna 22 sufficiently to cover the desired communications band of FIG. 5, antenna 22 may be provided with two or more antenna resonating element arms. As shown in FIG. 7, a first arm in this type of configuration may give rise to a first frequency response curve (curve 70) and a second arm may give rise to a second frequency response curve (curve 72). To ensure that the peak associated with curve 72 is slightly higher in frequency than the peak associated with curve 70, the second arm in antenna resonating element 50 may be constructed to be slightly shorter than the first antenna resonating arm.

As shown by curve 74 of FIG. 7, when a two-arm antenna resonating element of this type is used, the resulting overall frequency response of antenna 22 will be sufficient to cover the entire desired communications band of FIG. 5. The use of an antenna resonating element with multiple arms or other features that tend to broaden the bandwidth of antenna 22 can therefore help to overcome bandwidth-narrowing characteristics of the type that are sometimes associated with using cavities such as cavity 48. If desired, additional arms may be used in antenna resonating element structure 50. The use of a two-arm arrangement for antenna resonating element structure 50 is illustrative. Antenna resonating element structure 50 may have any suitable number of resonating element portions (e.g., arms) and any suitable trace geometry.

Figure 8:
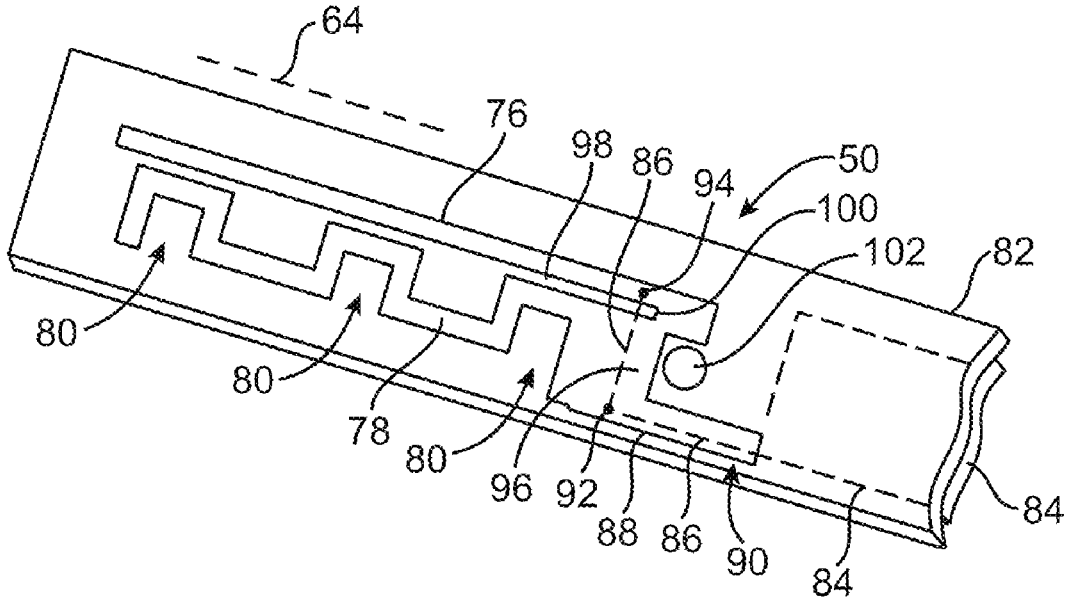
FIG. 8 is a perspective view of a resonating element portion of a cavity antenna for a wireless electronic device in accordance with an embodiment of the present invention.

An illustrative antenna resonating element structure that may be used in antenna 22 is shown in FIG. 8. As shown in FIG. 8, antenna resonating element structure 50 may have a first antenna resonating element arm such as arm 78 and a second antenna resonating element arm such as arm 76. Arm 78 may have a longer length than arm 76. In this type of configuration, arm 78 may be associated with a lower frequency response (e.g., curve 70 of the graph of FIG. 7) and arm 76 may be associated with a higher frequency response (e.g., curve 72 of the graph of FIG. 7).

If there is sufficient space available in device 10, arms such as arms 76 and 78 may both be constructed using straight traces (i.e., traces that have the elongated straight shape of trace 76 in the FIG. 8 example). In situations in which less area is available, one or both of arms 76 and 78 may be provided with bends. Bends may be used, for example, to fold an antenna arm back on itself. In the FIG. 8 example, arm 78 has a series of bends that form indentations 80. Arm 78 therefore follows a meandering path. The meandering path that is used for arm 78 lengthens arm 78 relative to arm 76 without extending the length of arm 78 along axis 64 past that of arm 76.

Arms 76 and 78 may be formed on a flexible printed circuit substrate or a rigid printed circuit board substrate such as substrate 82. If desired, integrated circuits and other circuitry may be mounted on substrate 82 to form an antenna module. As shown in FIG. 8, for example, radio-frequency integrated circuit 84 (e.g., a transceiver circuit) may be mounted to the underside of substrate 82. Vias or other conductive structures may be used to electrically interconnect circuitry 84 with traces 76 and 78. Traces 76 and 78 may be formed on the uppermost surface of substrate 82 as shown in FIG. 8 or may be formed in an interior layer or backside layer of substrate 82.

As shown in FIG. 8, trace 88 may be formed from an extended portion of arm 78. Antenna trace 86, which runs parallel to trace 88 in region 90 may be formed in a different layer of substrate 82 than trace 88. For example, trace portion 88 may be formed on the uppermost surface of substrate 82, whereas trace 86 may be formed on a lower layer of substrate 82. Substrate 82 may be, for example, a multi-layer printed circuit board.

In region 90, trace 86 and conductive portion 88 of arm 78 form a transmission line that conveys signals from circuit 84 to arms 76 and 78. At point 92, trace 88 may bend towards arm 76. Trace portion 88 of arm 78 in region 90 may serve as a localized ground feed terminal. At point 94, trace 86 may be interconnected to arm 76 to serve as a positive antenna feed terminal.

Arms such as arms 76 and 78 may be considered to form a two-arm monopole antenna architecture for antenna 22. Cavity 48 serves as a cavity portion of antenna 22. Antenna 22 may therefore sometimes be referred to as a cavity-backed monopole. The opposing conductive portions of arms 76 and 78 form slot 98. Interaction between conductive walls 56 of cavity 48 and the monopole resonating element structures contribute an inductive impedance component to the input impedance for antenna 22. This tends to make the optimum feed location for antenna 22 close to end 100 of slot 98. If desired, other suitable feed arrangements may be used for feeding antenna 22. The arrangement of FIG. 8 in which traces in substrate 82 such as trace 86 and conductive arm portion 88 are used to convey signals between circuit 84 and antenna resonating element arms 76 and 78 is merely illustrative.

As shown in FIG. 8, substrate 82 of resonating element structure 50 may have a hole such as hole 102. When mounting resonating element structure 50 into cavity 48 of antenna 22, a screw may be inserted through hole 102 and into associated threaded screw hole 60 in cavity 48 (FIG. 3). When inserted in this way, the screw may electrically connect with antenna traces in the vicinity of hole 102, thereby grounding the antenna to portion 58 of cavity 48 (FIG. 3) and shorting portion 58 to frame 62.

Figure 9:
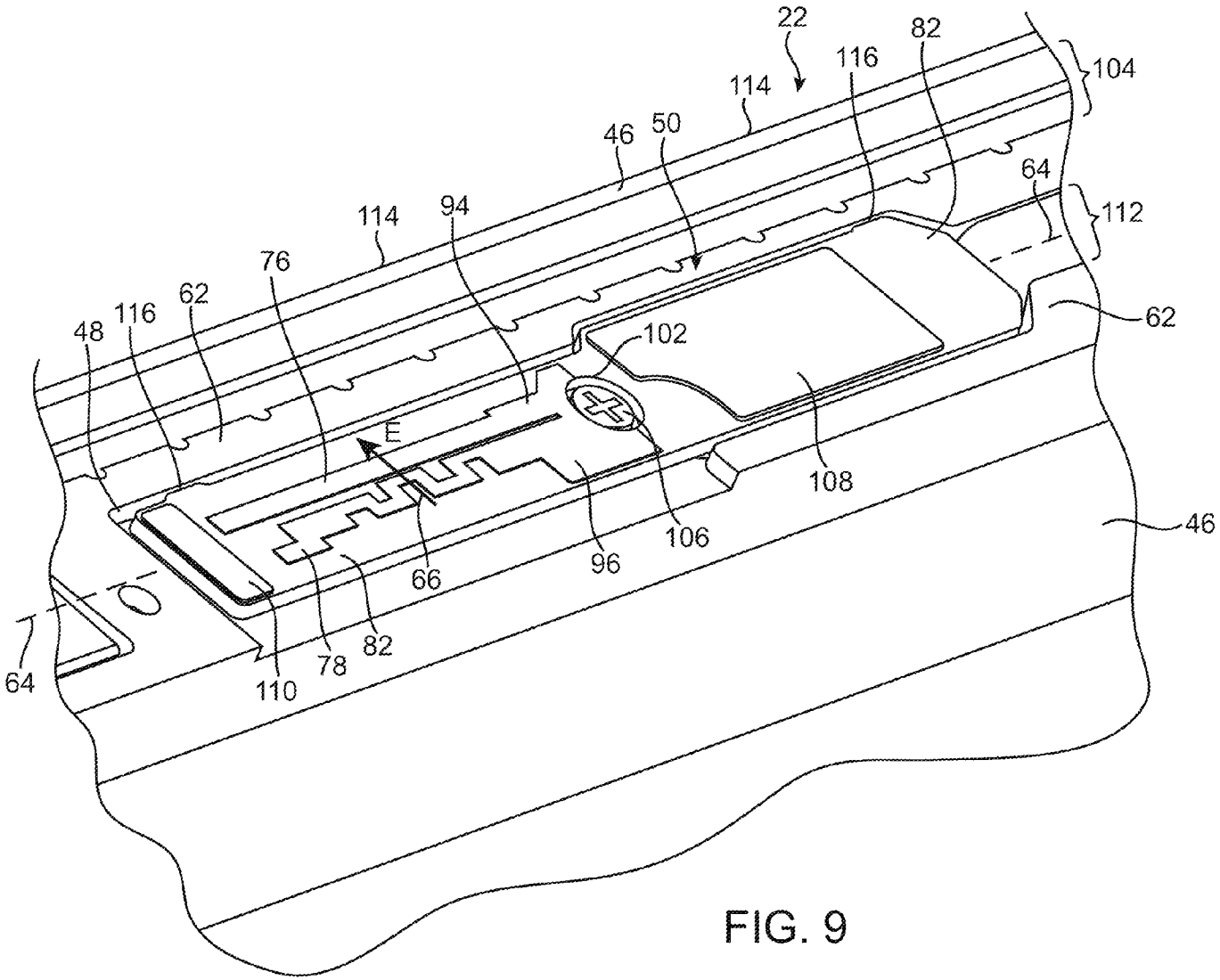
FIG. 9 is a perspective view of an illustrative cavity antenna formed in a portion of a portable computer cover in accordance with an embodiment of the present invention.

A perspective view of an illustrative embodiment of antenna 22 formed by mounting antenna resonating element structure 50 in cavity 48 is shown in FIG. 9. As shown in FIG. 9, antenna resonating element structure 50 may have a shorter antenna resonating element arm such as arm 76 and a longer antenna resonating element arm such as meandering arm 78. Because arms 76 and 78 form a two arm monopole antenna, antenna 22 may be referred to as cavity-backed monopole antenna. Arms 76 and 78 form monopole antenna resonating elements that are aligned with longitudinal axis 64 of cavity 48. Each arm has a longitudinal axis that runs parallel to axis 64.

Arms 76 and 78 run parallel to each other and form a slot (slot 98 of FIG. 8). Arms 76 and 78 may be fed across this slot (e.g., using feeds such as feeds 94 and 96, as described in connection with FIG. 8). Substrate 82 has planar upper and lower surfaces. The traces on substrate 82 such as the traces of arms 76 and 78 therefore lie in the plane formed by the surface opening of cavity 48. During operation, radio-frequency signals tend to be polarized so that the electric field of the signals is oriented as shown by E-field vector 66, perpendicular to longitudinal axis 64 of cavity 48 and antenna 22. The dimensions of cavity 48 (length, width, and depth) may each be substantially less than a half of a wavelength at the operating frequencies for antenna 22 (e.g., one half of a half wavelength or less, one quarter of a half wavelength or less, one fifth of a half wavelength or less, etc.).

Screw 106 may be used to screw substrate 82 to a threaded hole in frame 62 (hole 102 of FIG. 8). Frame 62 may be, for example, a frame that is used to form a structural support for display 20 (FIG. 1) in upper housing portion 16. Frame 62 may be formed from aluminum or other suitable conductive materials. Because frame 62 is formed from a conductor, the walls of cavity 48 are conductive. Housing structure 46 may be, for example, a thin layer of metal that forms the outer surface layer of cover 16. Frame 62 may be mounted to the inside surface of metal layer 46 using welds, adhesive, fasteners, or other suitable attachment mechanisms.

Gasket 104 may be interposed between frame 62 and edge 114 of housing layer 46. Gasket 104 can be formed from a soft elastomeric material that helps prevent cover glass 52 (FIG. 2) from becoming damaged by direct contact with edge 114. Region 112 in frame 62 can be recessed and can include a flex circuit communications path such as flex circuit portion 24A of FIG. 4.

Substrate 82 forms a support structure for traces 76 and 78. Substrate 82 may have tabs 116 or other lateral protrusions that help align substrate 82 with cavity 48. Spacers such as spacers 110 and 108 may be formed on the upper surface of substrate 82. Spacers 110 and 108 may be formed from plastic film (tape) or any other suitable flexible layer. Spacers 110 and 108 may have a height measured from the planar upper surface of substrate 82 that is higher than the height of conductive traces 76 and 78. When cover glass 52 is mounted to upper housing 16, spacers 108 and 110 prevent the inner surface of glass 52 from bearing directly against surface features in substrate 82 such as antenna resonating element traces 76 and 78. Spacers 108 and 110 therefore protect antenna 22 from damage by bezel region 18 of cover glass 52. If desired, graphics and text may be may be printed on spacer 108 to serve as a label.

Figure 10:
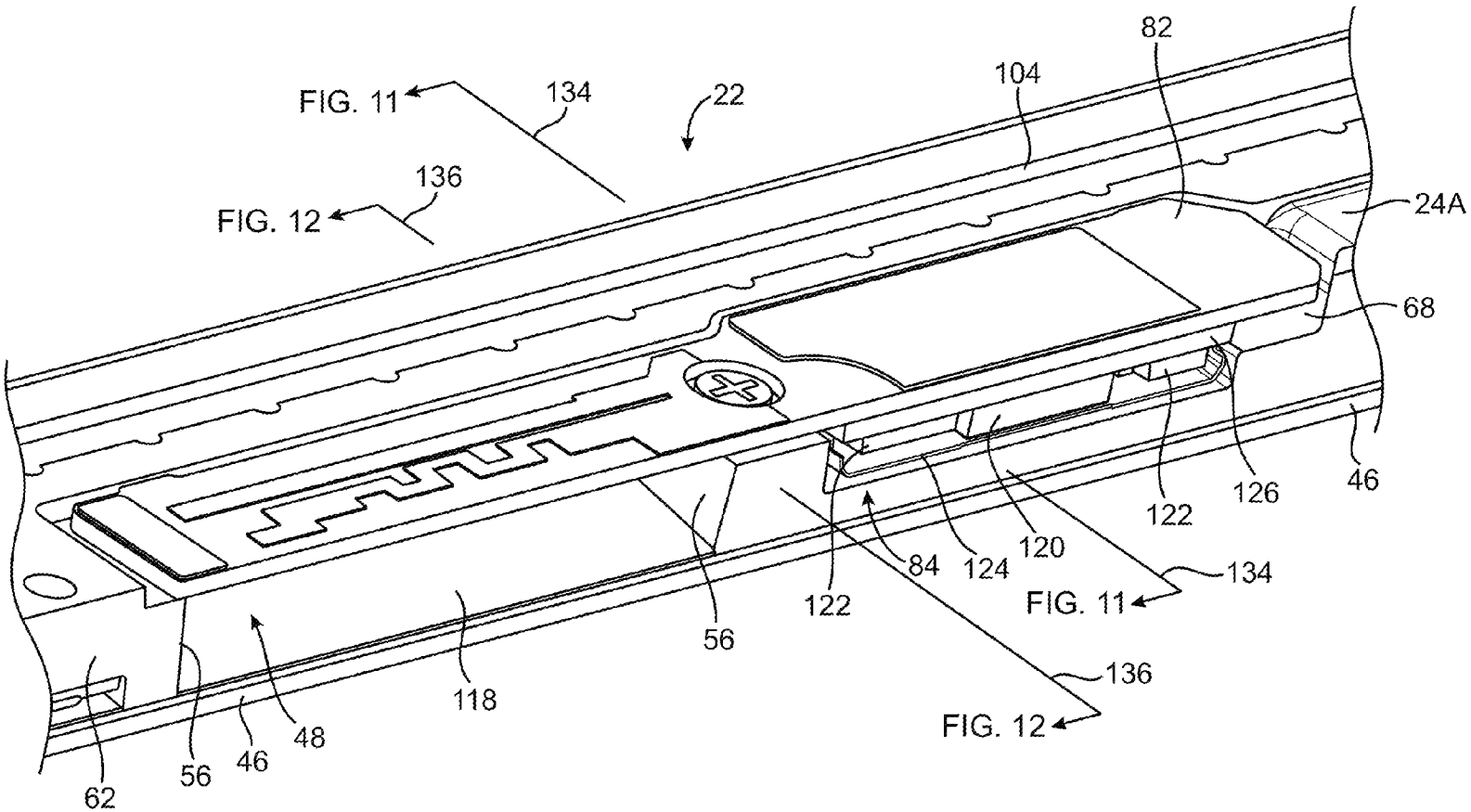
FIG. 10 is a longitudinal cross-sectional perspective view of a portion of the illustrative cavity antenna of FIG. 9 in accordance with an embodiment of the present invention.

A cross-sectional view of antenna 22 of FIG. 9 is shown in FIG. 10. As shown in FIG. 10, cavity 48 may have a lower face 118 (sometimes referred to as a lower wall or bottom surface) that is formed from the flat inner surface of metal layer 46. Cavity sidewalls 56 are shown as being formed from the inwardly facing portions of frame 62. If desired, cavity 48 may be formed using other conductive structures. For example, a metal insert may be used to form cavity 48 or the sidewalls and bottom surface of cavity 48 may be formed using other conductive structures in device 10.

As described in connection with FIG. 8, circuitry 84 may be mounted to the lower portion of substrate 82. Circuitry 84 may be electromagnetically shielded by metal can 124. Frame 64 may be recessed to accommodate can 124 and the circuitry 84 that is mounted within can 124. Circuitry 84 may include a radio-frequency transceiver integrated circuit such as radio 120, other transceiver components such as components 122, and other discrete and integrated circuit devices. These circuit components may be mounted on sub-board 126. Sub-board 126 may be a printed circuit board that is mounted to the underside of substrate 82. Zero insertion force connector 68 may also be mounted to the underside of substrate 82 and may be used to form a connection between circuitry 84 and flex circuit communications path 24A.

Figure 11:
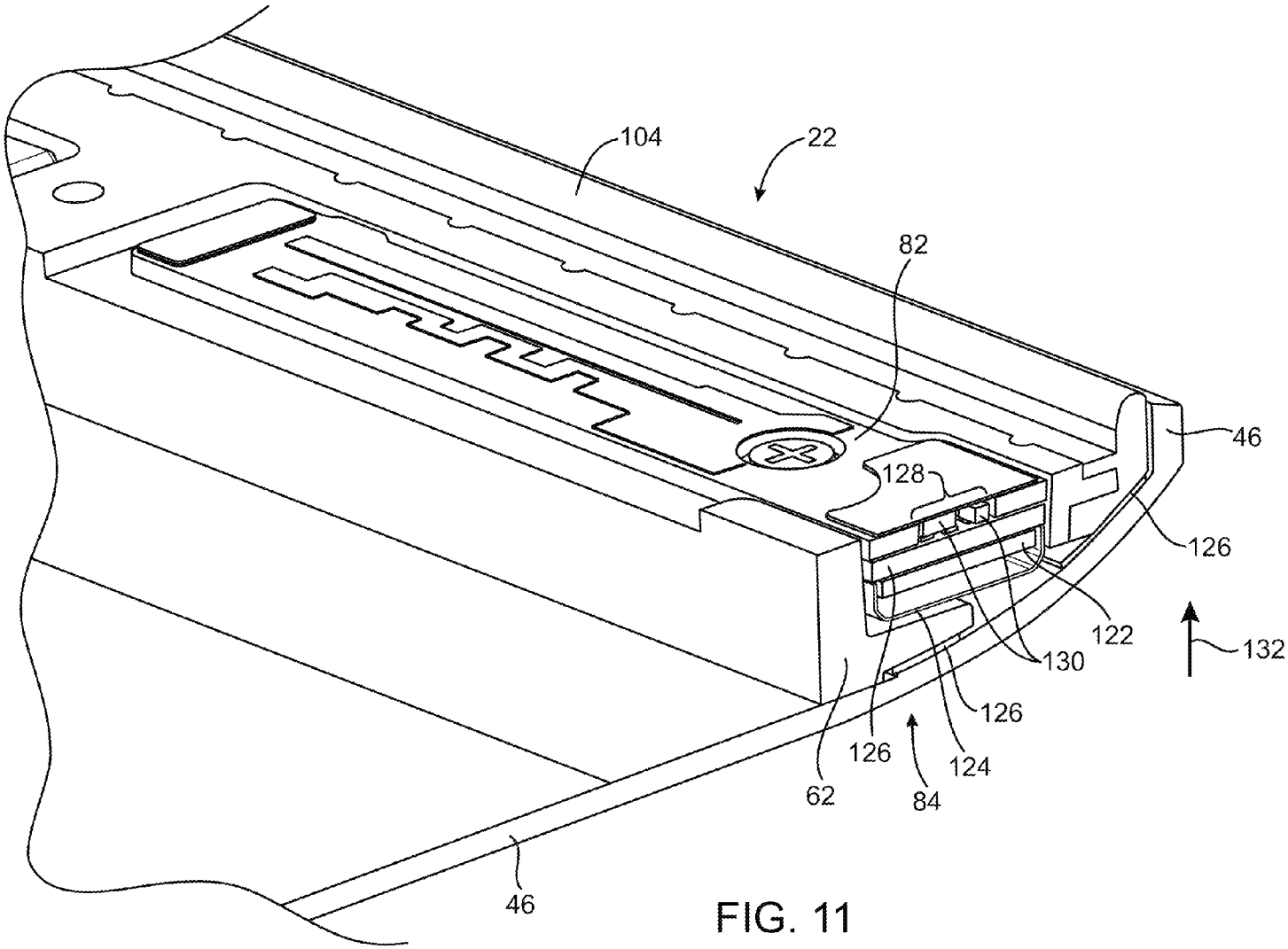
FIGS. 11 and 12 are each lateral cross-sectional perspective views of respective portions of the illustrative cavity antenna of FIG. 9 in accordance with embodiments of the present invention.

A cross-sectional perspective view of the antenna assembly of FIG. 10 taken along line 134 of FIG. 10 is shown in FIG. 11. As shown in FIG. 11, adhesive 126 such as double-sided adhesive tape may be used to help attach frame 62 and gasket 104 to metal layer 46 of cover 16.

FIG. 11 also shows how substrate 82 may have an opening in region 128 to accommodate components 130. Components 130 may be mounted on printed circuit board 126. By forming opening 128, board 126 may be mounted with its upper surface flush with the lower surface of substrate 82. In this configuration, circuit components 130 protrude upwardly in direction 132 into the interior of hole 128. This arrangement allows circuitry 84 to be compactly mounted in antenna 22 (i.e., in the assembly formed by antenna 22).

Figure 12:
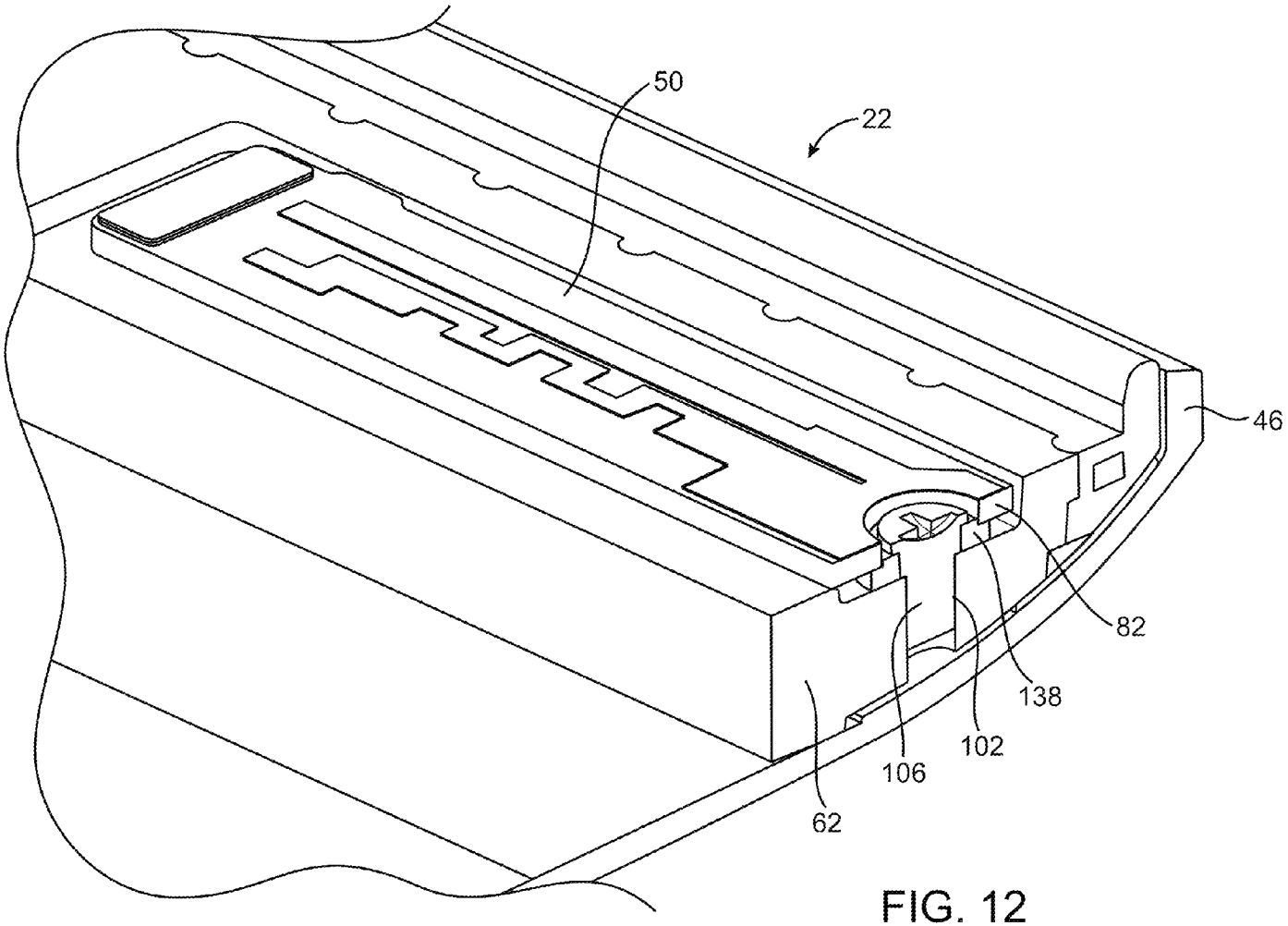

A similar cross-sectional perspective view of antenna 22, but taken along line 136 of FIG. 10 is shown in FIG. 12. As shown in FIG. 12, screw 106 may be screwed into threaded screw hole 102 to help attach antenna resonating element structure 50 to frame 62. This may be accomplished by attaching a washer such as washer 138 to the underside of substrate 82 and by pressing washer 138 against frame 62 by tightening screw 106. Conductive traces (e.g., a conductive trace on the underside of substrate 82) may be used to form a ground path between screw 106 and the antenna ground of antenna resonating element 50. If desired, a washer may be provided on the upper surface of substrate 82. Frame 62 may be electrically connected to metal layer 46, thereby grounding frame 62 to metal layer 46.

The foregoing is merely illustrative of the principles of this invention and various modifications can be made by those skilled in the art without departing from the scope and spirit of the invention.

What is claimed is:

1. A cavity-backed monopole antenna for a portable wireless electronic device, comprising:

a conductive cavity having a longitudinal axis; and a monopole antenna resonating element structure with at least one conductive portion having a longitudinal axis parallel to the longitudinal axis of the cavity, wherein the monopole antenna resonating element structure has at least two traces that form at least first and second arms, wherein the first arm and the second arms have different lengths and each support radio-frequency communications with the cavity-backed monopole antenna in different and overlapping first and second frequency ranges.

2. The cavity-backed monopole antenna defined in claim 1 wherein the portable electronic device has a metal frame and wherein portions of the metal frame comprise conductive sidewalls for the cavity.

3. A portable electronic device, comprising:

housing structures defining a conductive cavity; and an antenna resonating element structure formed on a substrate that is mounted to the cavity to form a cavity-backed antenna for the portable electronic device, wherein circuitry is mounted to the substrate.

4. The portable electronic device defined in claim 3 further comprising:

glass that covers the antenna resonating element structure.

5. The portable electronic device defined in claim 4 wherein at least one spacer is mounted on the antenna resonating element structure that protects the antenna resonating element structure.

6. The portable electronic device defined in claim 3, wherein the circuitry comprises electrical components and wherein the antenna resonating element structure comprises a printed circuit board having an opening through which the electrical components protrude.

7. The portable electronic device defined in claim 3 further comprising a cover having a metal layer and a metal frame, wherein the metal layer forms a lower surface of the cavity and wherein the frame forms sidewalls for the cavity.

8. The portable electronic device defined in claim 7 further comprising:

a display; and a cover glass that covers the display, wherein the cover glass has a bezel portion that overlaps the cavity.

9. The portable electronic device defined in claim 8 wherein the bezel portion is opaque and blocks the antenna from view.

10. The portable electronic device defined in claim 3 wherein the antenna operates at a desired communications frequency and wherein the cavity has dimensions substantially less than a half of a wavelength at the desired communications frequency.

11. The portable electronic device defined in claim 10 further comprising:

an upper housing portion that contains the antenna; and a lower housing portion to which the upper housing portion is rotationally mounted, wherein the desired communications frequency is in the range of 2.4 GHz to 2.5 GHz, wherein the portable electronic device further comprises a communications path that connects the antenna to circuitry in the lower housing portion, and wherein the communications path includes a flex circuit.

12. A portable electronic device, comprising:

housing structures defining a conductive cavity; and an antenna resonating element structure mounted to the cavity to form a cavity-backed antenna for the portable electronic device, wherein circuitry is mounted to the antenna resonating element structure, and wherein the cavity has a longitudinal axis and wherein the antenna resonating element structure has conductive traces that form multiple antenna resonating element arms that run substantially parallel to the longitudinal axis.

13. A portable electronic device, comprising:

housing structures defining a conductive cavity; and an antenna resonating element structure mounted to the cavity to form a cavity-backed antenna for the portable electronic device, wherein circuitry is mounted to the antenna resonating element structure, and wherein the antenna resonating element structure comprises straight and meandering antenna resonating element arms.

14. An antenna comprising:

a conductive cavity formed at least partially from conductive structures in a laptop computer; and a two-arm monopole antenna resonating element mounted over the cavity to form a cavity-backed monopole antenna for the laptop computer, wherein the two arms are of unequal lengths.

15. The antenna defined in claim 14 wherein a conductive metal laptop computer housing layer forms at least one surface of the cavity.

16. The antenna defined in claim 15 wherein the antenna operates in a frequency range of about 2.4 GHz to 2.5 GHz, wherein the two-arm monopole antenna resonating element has a substrate to which circuitry is mounted, and wherein the laptop computer has a frame in which a recess is formed within which the substrate is mounted.

17. The antenna defined in claim 14 wherein the two-arm monopole antenna resonating element is formed from conductive traces on a planar substrate having a planar upper surface and wherein the cavity has a planar surface opening in which the planar upper surface lies.

18. The antenna defined in claim 17 wherein the cavity has a longitudinal axis and wherein at least one of the two arms runs parallel to the longitudinal axis.

19. The antenna defined in claim 18 further comprising at least one printed label mounted to the planar upper surface, wherein the printed label has a height measured from the planar upper surface that is higher than the conductive traces.

* * * * *